US006886322B2

(12) United States Patent
Weide et al.

(10) Patent No.: US 6,886,322 B2
(45) Date of Patent: May 3, 2005

(54) YARN WITHDRAWAL NOZZLE

(75) Inventors: Thomas Weide, Mönchengladbach (DE); Bert Schlömer, Heinsberg (DE)

(73) Assignee: W. Schlafhorst AG & Co., Monchengladbach (DE)

( * ) Notice: Subject to any disclaimer, the term of this patent is extended or adjusted under 35 U.S.C. 154(b) by 0 days.

(21) Appl. No.: 10/621,026

(22) Filed: Jul. 16, 2003

(65) Prior Publication Data

US 2005/0011178 A1 Jan. 20, 2005

(51) Int. Cl.[7] ..... D01H 4/08
(52) U.S. Cl. ..... 57/404; 57/417
(58) Field of Search ..... 57/404–417

(56) References Cited

U.S. PATENT DOCUMENTS

| | | | | |
|---|---|---|---|---|
| 3,789,597 A | | 2/1974 | Schon | 57/58.89 |
| 3,805,505 A | | 4/1974 | Schuster | 57/58.89 |
| 3,834,147 A | * | 9/1974 | Havranek et al. | 57/417 |
| 4,610,134 A | | 9/1986 | Busch et al. | 57/417 |
| 4,665,687 A | | 5/1987 | Ott et al. | 57/417 |
| 4,702,069 A | | 10/1987 | Maximov et al. | 57/417 |
| 5,423,177 A | | 6/1995 | Raasch | 57/417 |
| 5,675,965 A | | 10/1997 | Mackey et al. | 57/417 |
| 6,035,625 A | | 3/2000 | Schlomer et al. | 57/417 |
| 6,389,789 B1 | * | 5/2002 | Preininger et al. | 57/417 |

FOREIGN PATENT DOCUMENTS

| | | |
|---|---|---|
| CH | 535 294 | 5/1973 |
| DE | 2 130 722 | 12/1972 |
| DE | OS 25 44 721 | 4/1977 |
| DE | 33 44 741 A1 | 6/1985 |
| DE | 37 07 526 A1 | 9/1988 |
| DE | 42 24 632 A1 | 1/1994 |
| DE | 197 38 382 A1 | 3/1999 |
| EP | 0 220 546 A1 | 5/1987 |
| EP | 0 422 615 B1 | 4/1991 |

OTHER PUBLICATIONS

European Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A yarn withdrawal nozzle for an open-end rotor spinning arrangement, having an inlet funnel and a coaxially arranged structure in the inlet funnel, as well as notches arranged in a spaced-apart manner that are positioned in the traveling direction of a yarn downstream of the coaxially arranged structure. The coaxially arranged structure is comprised of circularly-shaped beads or grooves of different diameters.

8 Claims, 5 Drawing Sheets

YARN WITHDRAWAL NOZZLE

FIELD OF THE INVENTION

The present invention relates to a yarn withdrawal nozzle for an open-end rotor spinning arrangement having a coaxially arranged structure in the inlet funnel of the yarn withdrawal nozzle.

BACKGROUND OF THE INVENTION

Yarn withdrawal nozzles for open-end rotor spinning arrangements have been known for a long time in various forms.

In connection with open-end rotor spinning arrangements, there exists the general problem that the real yarn twist introduced by the rotation of the spinning rotor does not evenly enter into the yarn being created.

The real yarn twist is applied to the piece of yarn which is located between the yarn withdrawal nozzle and the yarn withdrawal device of the open-end rotor spinning arrangement.

However, the real yarn twist often enters the piece of yarn located upstream of the yarn withdrawal nozzle only very incompletely.

Since too low a yarn twist in the piece of yarn located between the rotor groove and the yarn withdrawal nozzle has extremely negative effects on the spinning stability of an open-end rotor spinning arrangement, yarn withdrawal nozzles, which are provided with a special surface structure, have already been developed in the past. By means of such preferably rough surface structures it is intended to increase the friction between the surface of the yarn withdrawal nozzle and the rotating yarn and, by means of this to apply a so-called false twist to the piece of yarn being created in addition to the real yarn twist.

Since the false twist extends into the piece of yarn located between the rotor groove and the yarn withdrawal nozzle, an appropriate surface structure of the yarn withdrawal nozzle leads to an improvement of spinning stability of such open-end spinning arrangements.

Numerous yarn withdrawal nozzles in very different embodiments are known in regard to their structural design, their materials or their surface structure.

For example, German Patent Publication DE-OS 25 44 721, German Patent Publication DE 33 44 741 A1 or European Patent Publication EP 0 422 615 B1 describe yarn withdrawal nozzles having notch-like depressions in the area of the yarn feed zone.

In accordance with German Patent Publication DE-OS 25 44 721, the yarn withdrawal nozzle is made of an oxide-ceramic material and has a peak-to-valley height of 0.2 to 0.7 mm in the area of the yarn feed funnel. Moreover, notches, which can have different notch opening angles, are arranged in the area of the yarn feed zone.

The yarn withdrawal nozzles described in German Patent Publication DE 33 44 741 A1 have an exchangeable yarn feed funnel, which is drawn from sheet steel and subsequently hardened.

The yarn feed funnel has either notches or protruding beads.

The notches can also be positioned in two ring-shaped arrangements, located one behind the other in the yarn traveling direction.

European Patent Publication EP 0 422 615 B1 relates to a yarn withdrawal nozzle having notches in the area of the yarn feed zone and protrusions in the area of its yarn withdrawal conduit.

The notches are intended to improve the spinning stability of the open-end spinning arrangement, while the protrusions in the yarn withdrawal conduit are used for producing a particularly hairy yarn.

Furthermore, a yarn withdrawal nozzle is known from Swiss Letters Patent 535 294, which has ring-shaped notches in the area of the inlet funnel, as well as notches which are arranged orthogonally in respect to these ring-shaped notches.

In this yarn withdrawal nozzle, the differently arranged notches overlap and constitute a plurality of relatively aggressive abutments for the rotating yarn. This known yarn withdrawal nozzle has not proven itself in actual use and was unable to prevail in the marketplace.

Although, as a rule, it was possible to somewhat increase the spinning stability of the open-end spinning arrangements by means of the above described yarn withdrawal nozzles, known as "notched nozzles" in the trade, the improvement of the spinning stability was achieved, at least in part, at the expense of the yarn quality that could be achieved.

However, in connection with open-end spinning arrangements, yarn withdrawal nozzles have been known for some time, which have a spiral-shaped structure in the area of the yarn feed zone. Examples of such yarn withdrawal nozzles include German Patent Publication DE 37 07 526 A1, German Patent Publication DE 42 24 632 A1 and European Patent Publication EP 0 220 546 A1.

As described in German Patent Publication DE 37 07 526 A1 or European Patent Publication EP 0 220 546 A1, for example, the spiral-shaped structure can be comprised of strip- or bead-like protrusions, which preferably extend over the entire yarn feed zone of the yarn withdrawal nozzle as far as to the start of the yarn withdrawal conduit of the yarn withdrawal nozzle.

A twist-back-up element with beads extending obliquely in respect to the yarn traveling direction is furthermore connected downstream of the yarn withdrawal nozzle in accordance with European Patent Publication EP 0 220 546 A1.

A yarn withdrawal nozzle with a spiral-shaped structure is described in European Patent Publication DE 42 24 632 A1.

There, the yarn withdrawal nozzle has spiral-like extending faces, which are straight in respect to the yarn traveling direction and are arranged, inclined at an angle, for obtaining yarn deflection points.

In the known yarn withdrawal nozzles, known as "spiral nozzles" in the trade, the yarn, while being withdrawn, slides over the raised parts of the spiral-shaped structures, wherein their orientation has been selected to be such that, with an appropriate rotational direction of the yarn, a push component in the direction toward the rotor groove becomes effective on the piece of yarn being created. This push component causes the real yarn twist introduced by means of the spinning rotor to be at least partially prevented from leaving the area between the rotor groove and the yarn withdrawal nozzle.

In contrast with yarn withdrawal nozzles with a smooth surface, with "spiral nozzles" designed in this way it is possible to retain a higher twist in the piece of yarn upstream of the yarn withdrawal nozzle and thereby to reduce the yarn breaks occurring during the spinning process somewhat, wherein the achieved yarn quality is generally quite good.

Although "spiral nozzles" typically provide better yarn values in comparison with the so-called "notched nozzles", they have the disadvantage that the spinning stability that can be achieved is often not quite satisfactory.

Therefore, attempts have already been made in the past to unite the respective advantages of the "notched nozzles" with the advantages of the "spiral nozzles" in a single structure.

Such a spiral/notched nozzle is described in German Patent Publication DE 197 38 382 A1, for example.

In this known yarn withdrawal nozzle, a spiral-shaped structure for retaining the real yarn twist is arranged in the inlet area, and notches are additionally positioned in the inlet area of the yarn withdrawal conduit.

The yarn withdrawal nozzles in accordance with German Patent Publication DE 197 38 382 A1 have very well proven themselves in actual use, which means that yarns of exceptional quality can be produced by means of them, in particular when spinning cotton, but also polyester/cotton mixtures.

However, as indicated above, these spiral/notched nozzles, are quite elaborate in respect to their production.

A relatively complex and as a whole quite expensive tool is required in the inlet area of the yarn withdrawal nozzles for producing the spiral-shaped structure.

It is disadvantageous in connection with these yarn withdrawal nozzles that the spiral-shaped structure runs out toward the edge of the yarn withdrawal nozzle, which leads to the distance between the yarn formation zone in the groove of the spinning rotor and the spiral-shaped structure for retaining the real yarn twist continuously changing in the course of spinning.

SUMMARY OF THE INVENTION

It is accordingly an object of the present invention to provide a further improved yarn withdrawal nozzle.

In accordance with the present invention, this object is addressed by providing a yarn withdrawal nozzle for an open-end rotor spinning arrangement having an inlet funnel, a coaxially arranged structure comprised of circularly-shaped beads or grooves of different diameters in the inlet funnel, and notches arranged in the traveling direction of a yarn that are spaced-apart from the coaxially-arranged structure and downstream of the coaxially arranged structure.

The yarn withdrawal nozzles in accordance with the present invention have the advantages that the complexity of the tools required for their production is significantly less than with yarn withdrawal nozzles with a spiral-shaped structure and that production with a substantially reduced rejection rate is possible.

The yarn withdrawal nozzles in accordance with the present invention can be produced more cost-effectively than existing spiral/notched nozzles.

The use of circularly-shaped beads or grooves of different diameters in the area of the inlet funnel of the yarn withdrawal nozzle ensures that a constant distance between the yarn formation zone in the spinning rotor and the structure for retaining the real yarn twist is provided, which has an advantageous effect on the yarn quality.

The circularly-shaped beads or grooves of different diameters contribute to an even yarn formation during the spinning process, while the notches, spaced apart and positioned downstream in relation to the traveling direction of the produced yarn, simultaneously provided a high degree of spinning stability of the open-end spinning arrangement.

In one arrangement, the circularly-shaped beads or grooves are preferably arranged concentrically.

In an alternative arrangement, the circularly-shaped beads or grooves are arranged axially spaced apart in the inlet funnel of the yarn withdrawal nozzle.

In both arrangements the surface pressure on the yarn is increased, to prevent too much real yarn twist leaving the critical area upstream of the yarn withdrawal nozzle.

An arrangement that has been shown to be particularly advantageous in this connection, is where two to six ring-shaped beads or grooves of different diameters are provided.

The best spinning results were obtained with three to four beads or grooves.

Notches have furthermore been arranged downstream in the traveling direction of the yarn in relation to the ring-shaped beads or grooves and spaced apart from this coaxially-arranged structure, assuring a high degree of spinning stability of the open-end spinning arrangement.

In one arrangement, three to eight notches are provided, and four to six notches are preferred.

In another arrangement of the present invention, the surface of the yarn withdrawal nozzle is polished at least in the area of the inlet funnel of the nozzle.

The greatest possible gentle treatment of the yarn while it is withdrawn from the spinning arrangement is achieved by polishing the surface of the yarn withdrawal nozzle, which clearly reduces the amount of dust.

The use of a heavy-duty ceramic material assures an above average service life of the yarn withdrawal nozzles of the present invention.

Due to the special fine grained texture and the high density of their material, the yarn withdrawal nozzles of the present invention are extremely wear-resistant.

The yarn withdrawal nozzles are advantageously produced by injection molding or diecasting. These known and proven production methods make possible a cost-effective manufacture, especially in large numbers, where the individual components can be produced with the highest degree of precision.

Further details of the invention can be gathered from a non-limiting exemplary embodiment presented in the following description with reference made to the drawings.

DESCRIPTION OF THE PREFERRED EMBODIMENTS

Figure 1:
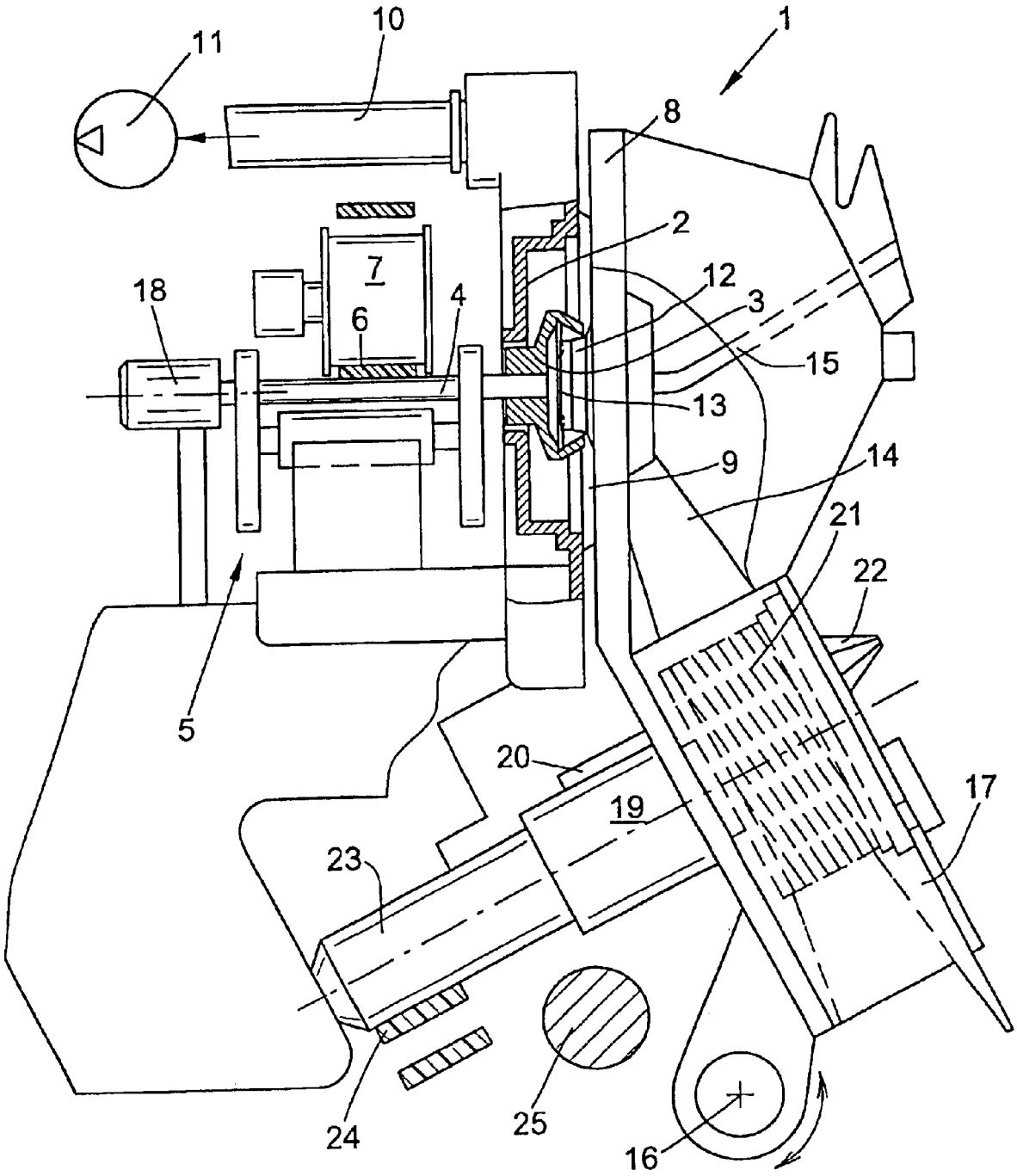
FIG. 1 is a schematic side elevational view, of an open-end spinning arrangement with a yarn withdrawal nozzle of the present invention.

The open-end rotor spinning arrangement 1 is shown in FIG. 1. Such spinning arrangements typically have a rotor housing 2, in which the spinning cup of a spinning rotor 3 rotates at a high number of revolutions.

The rotor shaft 4 of the spinning rotor 3 is supported in the bearing nips of a so-called support-disk bearing 5 and is driven by a tangential belt 6, which extends over the length of the machine and is acted upon by a pressure roller 7.

The axial fixation of the rotor shaft 4 is provided, for example, by a permanent-magnetic axial bearing 18.

The rotor housing 2, open toward the front, can be closed off during the spinning operation by a pivotably seated cover element 8.

A conduit plate, which rests by means of a circumferential lip seal 9 against the rotor housing 2, is placed into the cover element.

The rotor housing 2 is furthermore connected by means of an appropriate exhaust line 10 to a suction source 11, which generates the suction required in the rotor housing 2 for spinning.

A conduit plate adapter 12 is interchangeably arranged in a receptacle of the conduit plate (not represented), which has a yarn withdrawal nozzle 13, as well as the inlet area of a fiber guide conduit 14.

As indicated in FIG. 1, a small yarn withdrawal tube 15 adjoins the yarn withdrawal nozzle 13.

Furthermore, a sliver opening arrangement is integrated into the cover element 8, which is seated, rotatable to a limited degree, on a pivot shaft 16.

The cover element 8 has an opening roller housing 17, as well as rear bearing brackets 19, 20 for seating an opening roller 21, or a sliver draw-in cylinder 22.

The opening roller 21 is driven by a rotating tangential belt 24, which extends over the entire machine and acts on a wharve 23 of the opening roller 21, while the driving of the sliver draw-in cylinder 22 preferably takes place via a driveshaft 25 extending over the length of the machine, or a worm-wheel gear (not represented).

Figure 2:
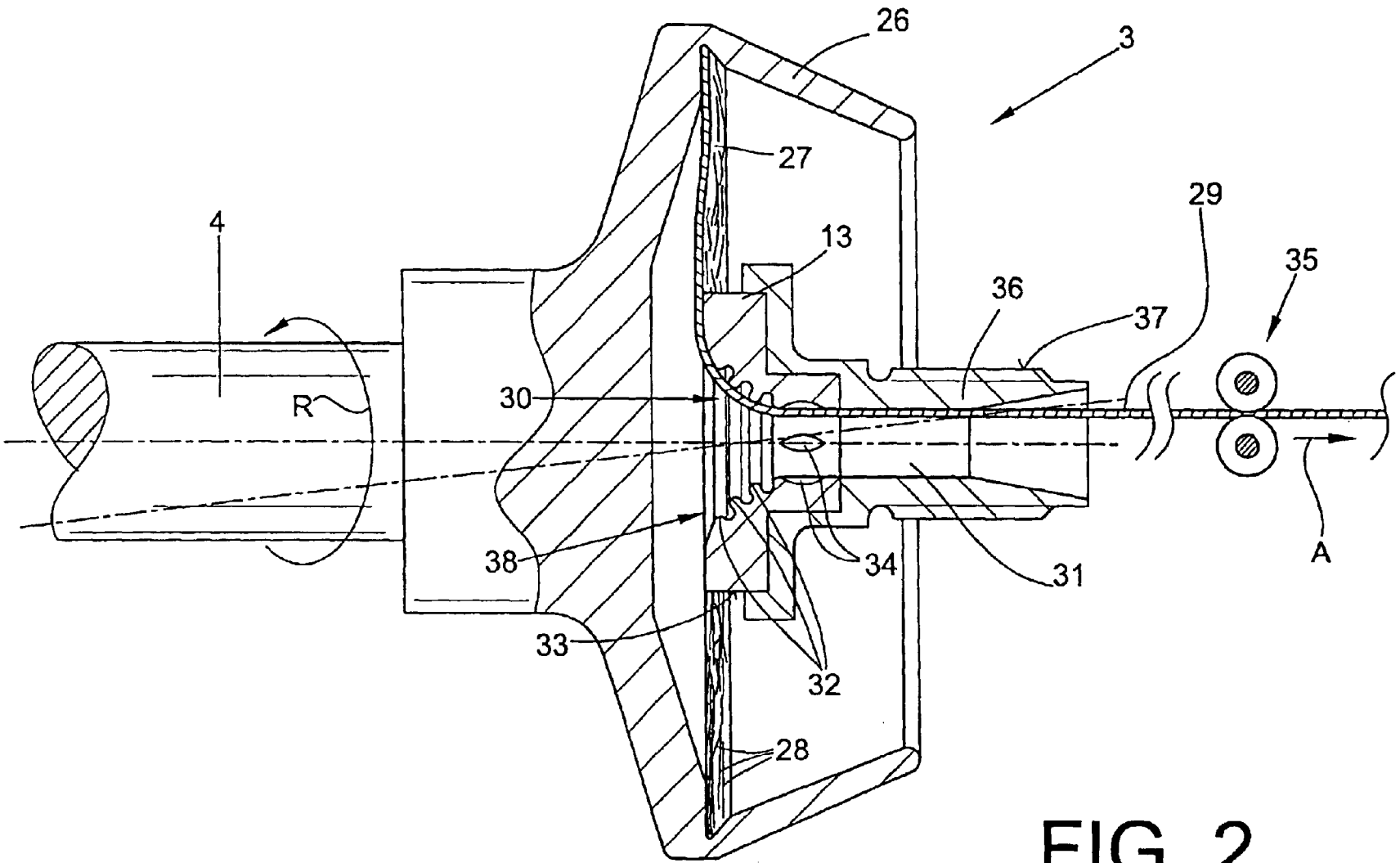
FIG. 2 is an enlarged side elevational and sectional view of a first arrangement of the yarn withdrawal nozzle of the present invention.
Figure 3:
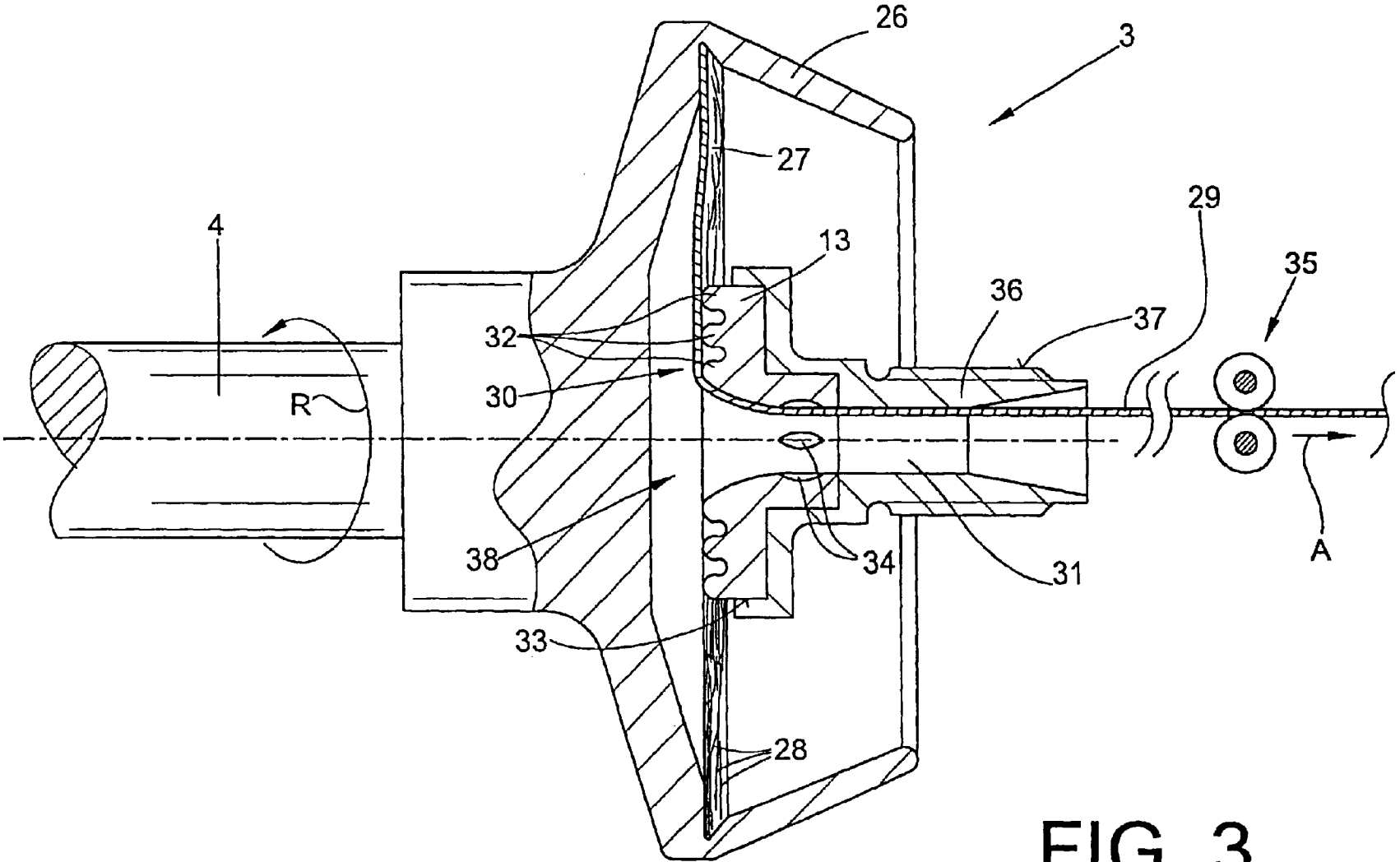
FIG. 3 is a further arrangement of the yarn withdrawal nozzle of the present invention.
Figure 4:
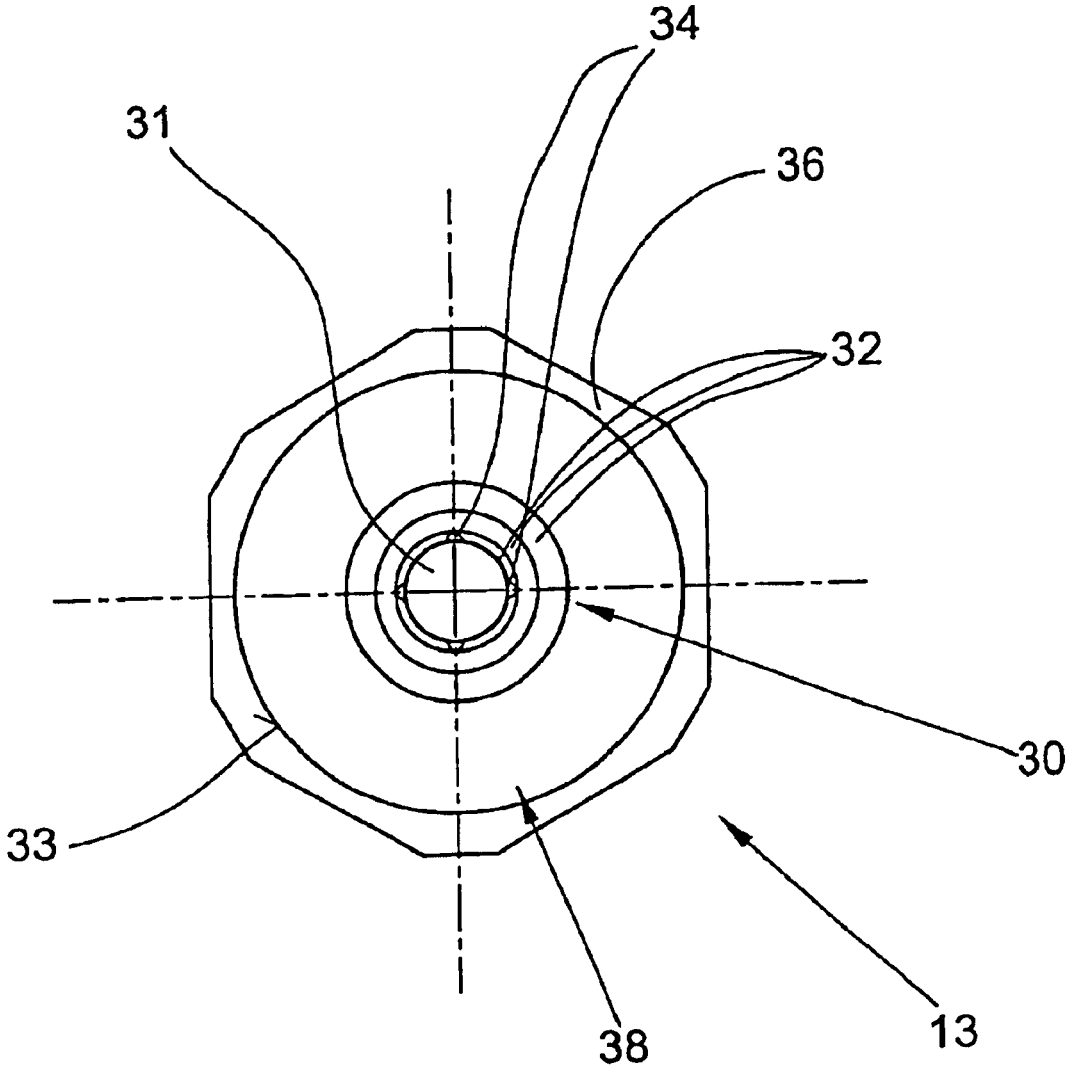
FIG. 4 is a front view of the yarn withdrawal nozzle of FIG. 2.
Figure 5:
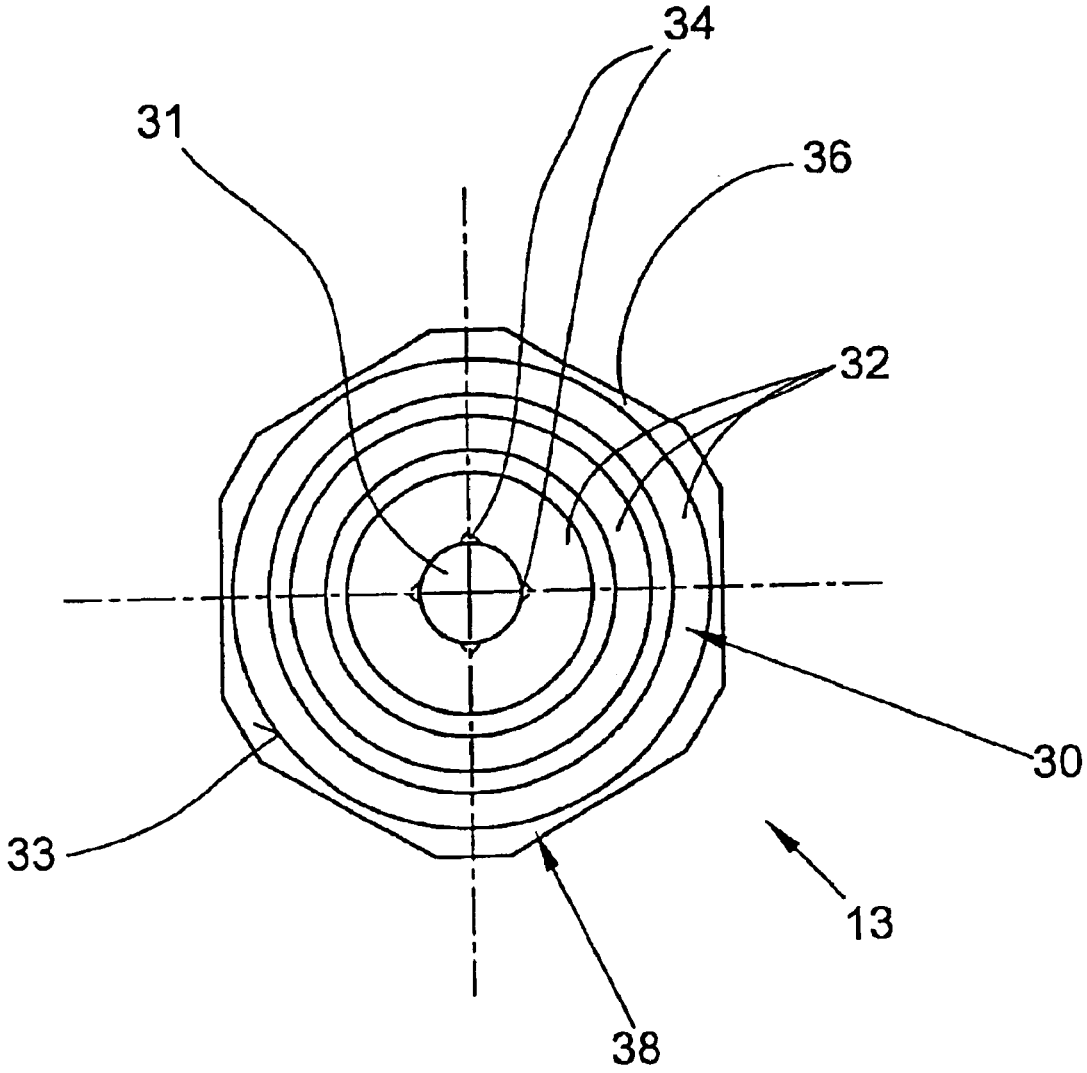
FIG. 5 is a front view of the yarn withdrawal nozzle of FIG. 3.

As shown in FIGS. 2 and 3, the yarn withdrawal nozzle 13 of the present invention is positioned inside the spinning cup 26, open toward the front, of the spinning rotor 3 during the spinning process.

The spinning cup 26, which has a so-called rotor groove 27, rotates inside the rotor housing 2 at a high number of revolutions in the direction R.

The individual fibers 28, removed by the opening roller 21 from a feeding sliver (not represented), are fed via the fiber guide conduit 14 into the spinning rotor 3 and, in the way customary in connection with open-end rotor spinning arrangements, are initially collected in the area of the rotor groove 27 of the spinning rotor 3.

In a so-called tie-up zone of the spinning rotor 3, the individual fibers 28 are then spun into a yarn 29, which is withdrawn through the withdrawal nozzle 13.

The yarn withdrawal speed with which the new yarn 29 is withdrawn out of the open-end spinning arrangement 1 in the direction A is a function of various factors, for example the motor rpm, the desired yarn twist, etc., and can be set by means of a yarn withdrawal device 35.

The yarn withdrawal nozzle 13 is fixed in place, preferably unreleasably, in a nozzle holder 36, which is connected, for example via an exterior thread 37 or a magnetic connection (not represented) with the conduit plate adapter 12.

In the area of its inlet funnel 38, the yarn withdrawal nozzle 13 has a coaxially arranged structure 30. This coaxially arranged structure 30 is formed either by circularly-shaped beads or by comparable annular groove 32 of different diameters.

Whether these are beads or grooves is a matter of preference.

FIG. 2 shows a yarn withdrawal nozzle 13, whose coaxially arranged structure 30 is constituted by circularly-shaped beads or grooves 32 of different diameters, which are arranged, axially spaced apart, in the area of the inlet funnel 38.

The exemplary arrangement of FIG. 3 shows a coaxially arranged structure 30 consisting of a plurality of concentrically arranged beads or grooves 32 of different diameters.

These concentrically arranged beads or grooves 32 preferably extend from the area of the outer rim 33 of the yarn withdrawal nozzle 13 as far as the start of the funnel-like inlet area of the yarn withdrawal nozzle 13.

Several notches 34 are additionally arranged, spaced apart from the coaxial structures 30 and downstream of the coaxial structures 30, viewed in the traveling direction A. In the present exemplary arrangements, the notches 34, respectively four notches 34 are represented, are located in the entry area of the yarn withdrawal conduit 31 of the yarn withdrawal nozzle 13.

Preferably, the yarn withdrawal nozzles 13 in accordance with the present invention are made of a heavy-duty ceramic material, for example $Al_2O_3$. This material is highly stable even under spot loads and resistant to a high degree to aging (oxidation). This oxidic hard material is furthermore distinguished by good heat conduction.

Regarding their exact arrangement, the above described, coaxially arranged structures 30 of the yarn withdrawal nozzle 13, as well as the arrangement of the notches, are expressly intended not to be limited to the exemplary arrangements represented in the drawings.

The beads or grooves can differ from the exemplary arrangements with respect to their number, as well as with respect to their width or height.

In the same way, for example as a function of the yarn material to be processed, the notches can be longer or shorter, wider or narrower, as well as deeper or shallower.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A yarn withdrawal nozzle for an open-end rotor spinning arrangement having a nozzle body defining a yarn withdrawal pathway, a coaxially-arranged yarn twisting structure comprised of discrete concentric circular beads or grooves of different diameters spaced apart along the yarn withdrawal pathway, and notches spaced radially apart from one another at a location downstream from the coaxially-arranged structure in the traveling direction of the yarn along the yarn withdrawal pathway.

2. The yarn withdrawal nozzle in accordance with claim 1, wherein the yarn withdrawal pathway includes a tapering funnel area, the circular beads or grooves being arranged, axially spaced apart, in the tapering funnel area.

3. The yarn withdrawal nozzle in accordance with claim 1, wherein the yarn withdrawal pathway includes a tapering funnel area, the circular beads or grooves being arranged, radially spaced apart, upstream of the funnel area in the traveling direction of the yarn.

4. The yarn withdrawal nozzle in accordance with claim 1, wherein two to six beads or grooves are provided.

5. The yarn withdrawal nozzle in accordance with claim 1, wherein three to eight notches are provided downstream from the coaxially-arranged structure in the traveling direction of the yarn along the yarn withdrawal pathway.

6. The yarn withdrawal nozzle in accordance with claim 1, wherein the yarn withdrawal nozzle has a surface that is polished at least in the tapering yarn inlet area.

7. The yarn withdrawal nozzle in accordance with claim 1, wherein the yarn withdrawal nozzle is comprised of a heavy-duty ceramic material distinguished by a special fine grained texture and high density.

8. The yarn withdrawal nozzle in accordance with claim 1, wherein the yarn withdrawal nozzle is produced by injection molding or diecasting.

* * * * *